US006626744B1

(12) United States Patent
White et al.

(10) Patent No.: US 6,626,744 B1
(45) **Date of Patent: *Sep. 30, 2003**

(54) PLANARIZATION SYSTEM WITH MULTIPLE POLISHING PADS

(75) Inventors: John M. White, Hayward, CA (US); Phillip R. Sommer, Newark, CA (US); Stephen Fisher, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/556,495

(22) Filed: Apr. 21, 2000

Related U.S. Application Data

(60) Provisional application No. 60/172,416, filed on Dec. 17, 1999.

(51) Int. Cl.[7] ..... B24B 1/00

(52) U.S. Cl. ..... 451/66; 451/168; 451/173; 451/307; 451/461

(58) Field of Search ..... 451/41, 57, 66, 451/56, 285–289, 307, 173, 168, 461

(56) References Cited

U.S. PATENT DOCUMENTS

| | | | | |
|---|---|---|---|---|
| 4,347,689 | A | | 9/1982 | Hammond |
| 4,642,943 | A | | 2/1987 | Taylor, Jr. |
| 5,065,547 | A | | 11/1991 | Shimizu et al. |
| 5,088,240 | A | | 2/1992 | Ruble et al. |
| 5,099,615 | A | | 3/1992 | Ruble et al. |
| 5,209,027 | A | | 5/1993 | Ishida et al. |
| 5,220,750 | A | | 6/1993 | Emberland et al. |
| 5,276,999 | A | | 1/1994 | Bando |
| 5,335,453 | A | | 8/1994 | Baldy et al. |
| 5,399,125 | A | | 3/1995 | Dozier |
| 5,443,415 | A | | 8/1995 | Shebanow et al. |
| 5,476,413 | A | | 12/1995 | Hasegawa et al. |
| 5,487,697 | A | | 1/1996 | Jensen |
| 5,490,808 | A | | 2/1996 | Jantschek et al. |
| 5,558,568 | A | | 9/1996 | Talieh et al. |
| 5,593,344 | A | | 1/1997 | Weldon et al. |
| 5,660,581 | A | | 8/1997 | Shin et al. |
| 5,676,590 | A | | 10/1997 | Hiraoka |
| 5,692,947 | A | | 12/1997 | Talieh et al. |
| 5,704,827 | A | | 1/1998 | Nishi et al. |
| 5,722,877 | A | | 3/1998 | Meyer et al. |
| 5,762,536 | A | | 6/1998 | Pant et al. |
| 5,800,248 | A | | 9/1998 | Pant et al. |
| 5,871,390 | A | | 2/1999 | Pant et al. |
| 5,897,426 | A | | 4/1999 | Somekh |
| 5,899,801 | A | | 5/1999 | Tolles et al. |
| 5,913,716 | A | | 6/1999 | Mucci et al. |
| 5,997,384 | A | | 12/1999 | Blalock |
| 6,059,643 | A | | 5/2000 | Hu et al. |
| 6,089,962 | A | | 7/2000 | Spinasse |
| 6,103,628 | A | | 8/2000 | Talieh |
| 6,123,607 | A | * | 9/2000 | Ravkin et al. ..... 451/56 |
| 6,193,588 | B1 | * | 2/2001 | Carlson et al. ..... 451/66 |
| 6,196,896 | B1 | * | 3/2001 | Sommer ..... 451/5 |
| 6,196,899 | B1 | * | 3/2001 | Chopra et al. ..... 451/56 |
| 6,241,583 | B1 | | 6/2001 | White |
| 6,244,935 | B1 | | 6/2001 | Birang et al. |
| 6,250,994 | B1 | * | 6/2001 | Chopra et al. ..... 451/56 |
| 6,379,231 | B1 | | 4/2002 | Birang et al. |

FOREIGN PATENT DOCUMENTS

| | | |
|---|---|---|
| EP | 0 756 917 | 2/1997 |
| EP | 0 818 272 | 1/1998 |
| JP | 62-162466 | 7/1987 |
| JP | 2-269553 | 11/1990 |
| JP | 4-250967 | 9/1992 |
| JP | 7-111256 | 4/1995 |

* cited by examiner

*Primary Examiner*—George Nguyen
(74) *Attorney, Agent, or Firm*—Moser, Patterson & Sheridan

(57) ABSTRACT

An apparatus for simultaneously polishing wafers including at least a first and a second web of polishing media. At least two polishing heads are provided on a carrier coupled to a drive system such that one polishing head positions a wafer against the first web and a second polishing head positions a second wafer against the second web. The drive system imparts a programmed polishing motion or pattern to the polishing heads.

16 Claims, 6 Drawing Sheets

PLANARIZATION SYSTEM WITH MULTIPLE POLISHING PADS

CROSS REFERENCE TO OTHER RELATED APPLICATIONS

This application is related to U.S. patent application Ser. Nos. 08/961,602, 08/833,278, U.S. Patent Application Ser. No. 60/172,416, all of which are hereby incorporated by reference in their entirety.

BACKGROUND OF THE DISCLOSURE

1. Field of Invention

The present invention relates generally to a semiconductor wafer planarization system. More specifically, the invention relates to a planarization system having multiple polishing pads or webs.

2. Background of Invention

In semiconductor wafer processing, the use of chemical mechanical planarization, or CMP, has gained favor due to the enhanced ability to stack multiple devices on a semiconductor workpiece, or substrate, such as a wafer. As the demand for planarization of layers formed on wafers in semiconductor fabrication increases, the requirement for greater system (i.e., tool) throughput with less wafer damage and enhanced wafer planarization has also increased.

Two CMP systems that address these issues are described in a patent to Perlov et al. (U.S. Pat. No. 5,804,507, issued Sep. 8, 1998) and in a patent to Tolles et al. (U.S. Pat. No. 5,738,574, issued Apr. 15, 1998), both of which are hereby incorporated by reference. Perlov et al. and Tolles et al. disclose a CMP system having a planarization apparatus that is supplied wafers from cassettes located in an adjacent liquid filled bath. A transfer mechanism, or robot, facilitates the transfer of the wafers from the bath to a transfer station. From the transfer station, the wafers are loaded to one of four processing heads mounted to a carousel. The carousel moves the processing heads and wafers to various planarization stations where the wafers are planarized by moving the wafer relative to a polishing pad in the presence of a slurry or other fluid medium. The polishing pad may include an abrasive surface. Additionally, the slurry may contain both chemicals and abrasives that aid in the removal of material from the wafer. After completion of the planarization process, the wafer is returned back through the transfer station to the proper cassette located in the bath.

Another system is disclosed in a patent to Hoshizaki et al. (U.S. Pat. No. 5,908,530, issued Jun. 1, 1999) which is hereby incorporated by reference. Hoshizaki et al. teaches an apparatus for planarizing wafers wherein the wafer is subjected to uniform velocity across the wafer surface with respect to the abrasive surface. The uniform velocity across the wafer surface coupled with a multi-programable planarization pattern results in a uniform rate of material removal from the wafer surface. In addition, Hoshizaki et al. provides a number of optional routines that allow a user to fine tune material removal from the wafer.

Another system is disclosed by Sommer in a U.S. Patent Application No. 60/169,770 (filed Dec. 9, 1999 hereinafter referred to as "Sommer '770") which is incorporated by reference in its entirety. Sommer '770 describes a planarization system comprising two polishing heads for retaining wafers coupled to a drive system disposed over a single web. By polishing two wafers simultaneously on a single web, the rate of wafer throughput is enhanced.

The systems described above can generally utilize polishing pads with and without abrasive finishes. The polishing pads may be stationary or move relative to the wafer, e.g., rotationally or linearly. Additionally, abrasive slurry, di-ionized water and other fluids may be moved to the polishing pad during the processing of the wafer.

One problem common to systems utilizing webs of polishing media is the difficulty in planarizing more than one wafer having a diameter of 300 mm (approximately $11\frac{13}{16}$ inches). 300 mm wafers are becoming increasingly desirable due to the ability to produce a greater number of devices on a single wafer. Currently, webs utilized as polishing pads are only available in widths up to 37 inches. These webs additionally only have a usable polishing area of about 34 inches. This conventional pad width will accommodate a polishing process that positions two 200 mm wafers side-by-side across the width of the pad when polishing, however, this pad width is insufficient to allow two 300 mm disposed side-by-side across the width of the web to travel in a polishing pattern adequate to satisfactorily planarize the wafers. As such, conventional planarization systems are limited to planarizing a single wafer across the width of the web and correspondingly, cannot obtain throughputs comparable to 200 mm systems.

Therefore, there is a need for an apparatus that provides increased throughput of 300 mm wafers in a chemical mechanical wafer planarization system.

SUMMARY OF INVENTION

One aspect of the present invention provides a chemical mechanical planarization system for planarizing wafers having a multiple webs. Generally, the system comprises a base, a first web disposed over the base, a second web disposed over the base, and a carrier having a first polishing head and a second polishing head. The first polishing head is movably disposed over the first web and the second polishing head is movably disposed over the second web. A drive system operably couples the carrier to the base such that the drive system moves each polishing head relative the to respective web in unison.

In an exemplary embodiment, each polishing head is moved in a polishing pattern comprising a first motion provided by a first linear motion device, and a second motion substantially perpendicular to the first motion provided by a second motion device. The system polishes at least one wafer per width of web, thus allowing polishing patterns for larger wafers, i.e., 300 mm wafers, as well as multiple smaller wafers to be accommodated.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAIL DESCRIPTION OF INVENTION

Figure 1:
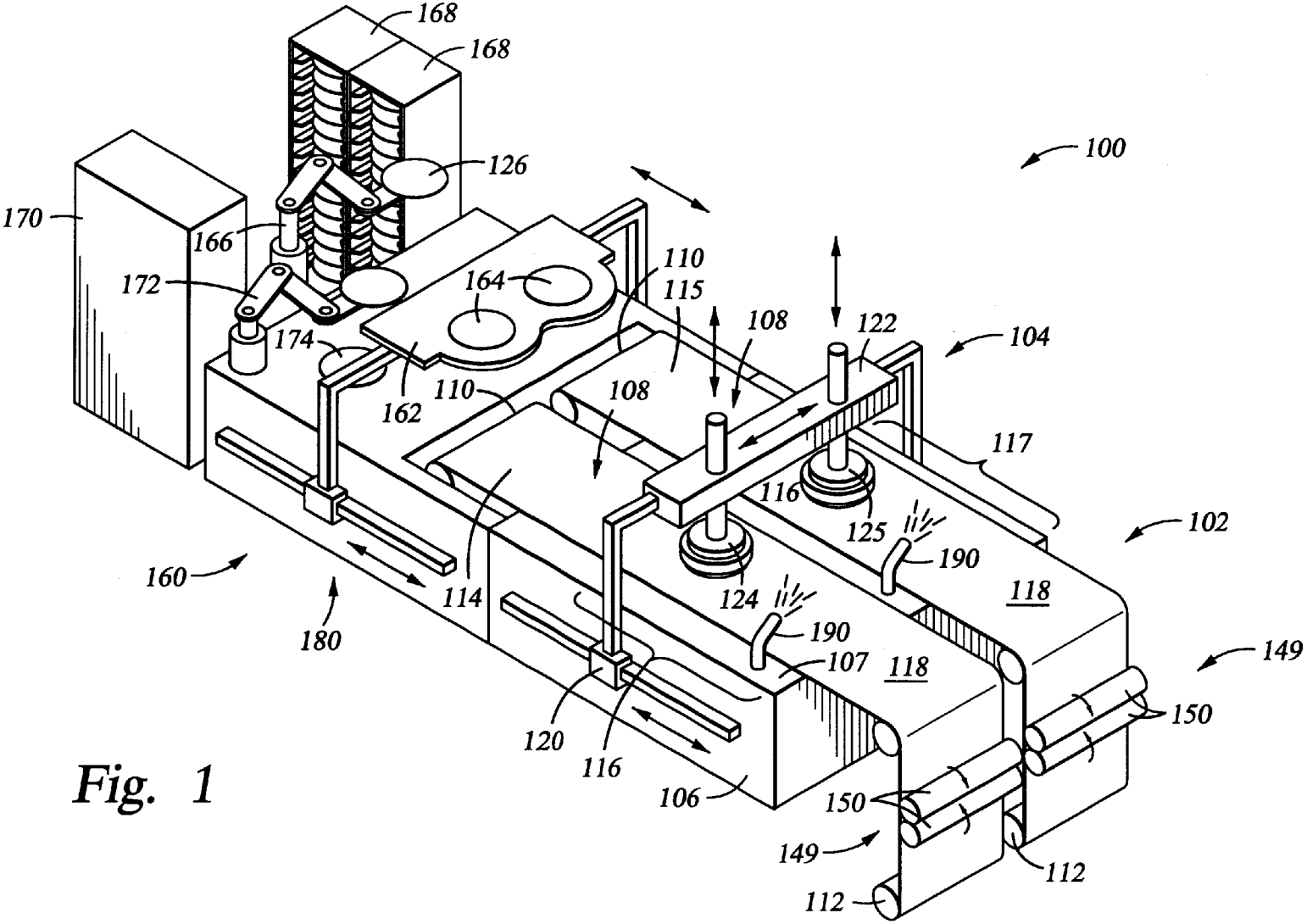
FIG. 1 is a schematic view of a chemical mechanical planarization system of the present invention.

FIG. 1 depicts a schematic view of a chemical mechanical planarization system 100 including multiple conditioning webs 108*a* and 108*b*. The system 100 generally comprises a front end 160, a polishing media magazine 102, a drive system 104 and a base 106.

The front end 160 generally comprises a load station 180, a cleaner 170, and a robot 166. The robot 166 is a conventional robot 166 commonly used to transfer substrates or wafers 126 into and out of and one or more wafer cassettes 168. The typical robot 166 is a single blade robot having a vacuum gripper disposed at the end of a pair of extendable arms. By applying vacuum to the gripper, the wafer 126 is retained by the robot 166 for transfer between the cassettes 168, the load station 180, and the cleaner 170.

The load station 180 generally comprises an edge grip robot 172, one or more substrate supports 174 and a shuttle 162. Unpolished wafers 126 retrieved from the cassette 168 by the robot 166 are set on the substrate support 174. The edge grip robot 172 retrieves the wafer 126 from the substrate support 174 by gripping the substrate at its edge. The edge grip robot 172 transfers the wafer 126 between the substrate support 174 and the shuttle 162.

The shuttle 162 is coupled to an actuator that permits the shuttle 162 to be selectively positioned between a first and second position. In the first position, the shuttle 162 receives the unpolished wafers 126 from the edge grip robot 172 into one of the one or more load cups 164 disposed on the shuttle 162. In the second position, the shuttle 162 transfers the unpolished wafer 126 from the load cup 164 to the drive system 104. The drive system 104 retains the wafer 126 during processing. Polished wafers return from the drive system 104 across the shuttle 162 in the opposite manner. An example of a shuttle table that may be adapted for use with the present invention is described in the previously incorporated U.S. patent application Sommer '770.

The polishing media magazine 102 generally comprises an unwind 110 and a winder 112. Multiple webs of polishing media 108*a* and 108*b* are run between the unwind 110 and the winder 112. Optionally, more than two webs of polishing media may by used. Typically a first web 108*a* of polishing media and a second web 108*b* of polishing media are run adjacent to each other between the unwind 110 and the winder 112. Alternatively, each web 108*a* and 108*b* may be disposed between a dedicated (i.e., separate) winder 112 and unwind 110. Each web (108*a* and 108*b*) can be substantially "rolled-up" at either the unwind 110 or the winder 112, or partially wound on both the unwind 110 and the winder 112 such that various portions of each web (108*a* and 108*b*) may be selectively exposed between the unwind 110 and the winder 112. Each web (108*a* and 108*b*) may be indexed or advanced, individually or in unison.

A working region 116 of the first web 108*a* is disposed on a polishing surface 107 of the base 106 of the system 100. The working region 116 of the first web 108*a* is orientated in relation to the base 106 such that a working surface 118 of the first web 108*a* is on the side of the first web 108*a* facing away from the base 106. A working region 117 of the second web 108*b* is similarly disposed on the polishing surface of the base 106. The working region 117 of the second web 108*b* is orientated in relation to the base 106 such that a working surface 119 of the second web 108*b* is on the side of the second web 108*b* facing away from the base 106. Optionally, the working surfaces 118 and 119 may comprise an abrasive coating, a plurality of abrasive elements comprising abrasive articles disposed in a binder (e.g., fixed abrasive pad), finish, covering and/or texture. An example of such a polishing media magazine configured to handle a single web in which the aspects of the invention can be advantageously incorporated is described by Sommer in U.S. patent application Ser. No. 08/833,278 (filed Apr. 4, 1997 and hereinafter referred to as "Sommer '278") which is incorporated by reference in its entirety.

The polishing media magazine 102 may further comprises a conditioning device 149. The conditioning device 149 conditions (i.e., dresses) the working surfaces 118 and 119 of the webs to create a uniformly textured surface that removes material from the surface of the wafers at a uniform rate. In one embodiment, the conditioning device 149 comprises two rollers 150 rotating in opposing directions that are selectively placed in contact with the working surfaces (118 and 119) of each web to condition the working surfaces. Other types of conditioning devices may optionally be utilized alone or in conjunction with the rollers 150. Examples of other conditioning devices include rotating disks, cylinders, rods and brushes, water jets, mega and ultrasonic devices. Additionally, the conditioning devices 149 may include conditioning elements having patterned surfaces or embossed surfaces, or surfaces containing oxides, ceramic or diamonds. Additional conditioning devices are also described by Sommer et al. in the previously incorporated U.S. Patent Application Ser. No. 60/172,416, filed Dec. 17, 1999.

The drive system 104 is coupled to the base 106. The drive system 104 typically comprises a first linear motion device 120, a second linear motion device 122, a first polishing head 124 and a second polishing head 125. The first polishing head 124 is movably positioned above the working region 116 of the first web 108*a*. The second polishing head 125 is movably positioned above the working region 117 of the second web 108*b*. The first linear motion device 120 and the second linear motion device 122 (which could be replaced by one device providing at least an equivalent range of motion) couples the polishing heads 124 and 125 to the base 106. The linear motion devices 120 and 122 move the polishing heads 124 and 125 in a synchronous programmable pattern in relation to the base 106. Optionally, more than one polishing head may be positioned along the length of the web. As one polishing head is disposed on a web width, large diameter wafers (i.e., 300 mm wafers) can be moved across the width of the web to travel in a polishing pattern that produces an advantageous planarized surface on the wafer. Additionally, the ability of the system to use a single drive system and multiple webs of polishing media to polish multiple wafers simultaneously provides greater wafer throughput as compared to systems that are limited to polishing one wafer at a time. The system 100 may also be configured to polish two wafers of smaller diameter across the width of each web (i.e., two wafers per web width) to provide greater throughput for systems planarizing wafers having a diameter less than 300 mm.

Figure 2:
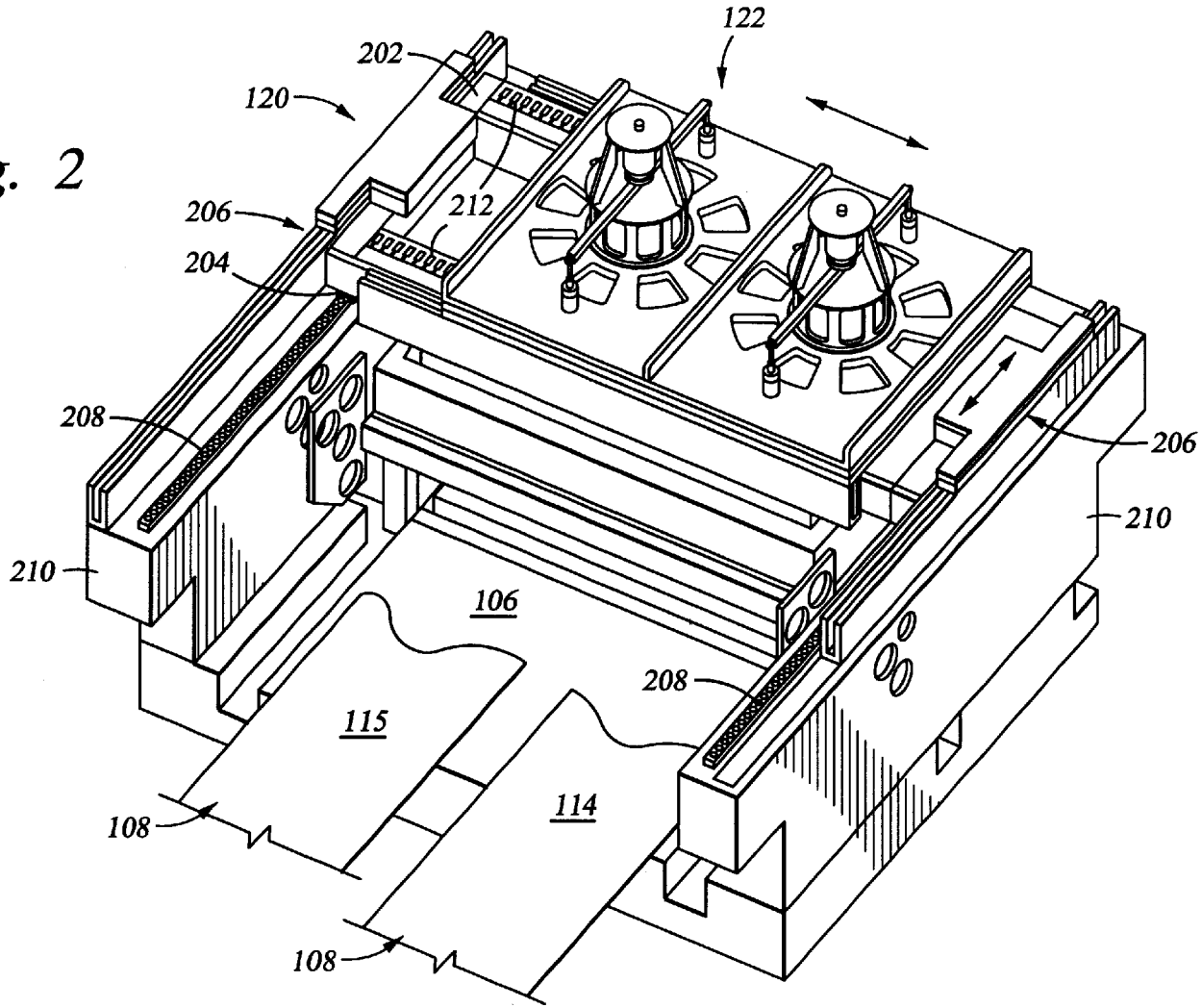
FIG. 2 is a perspective view of a drive system of the chemical mechanical planarization system of FIG. 1.
Figure 3:
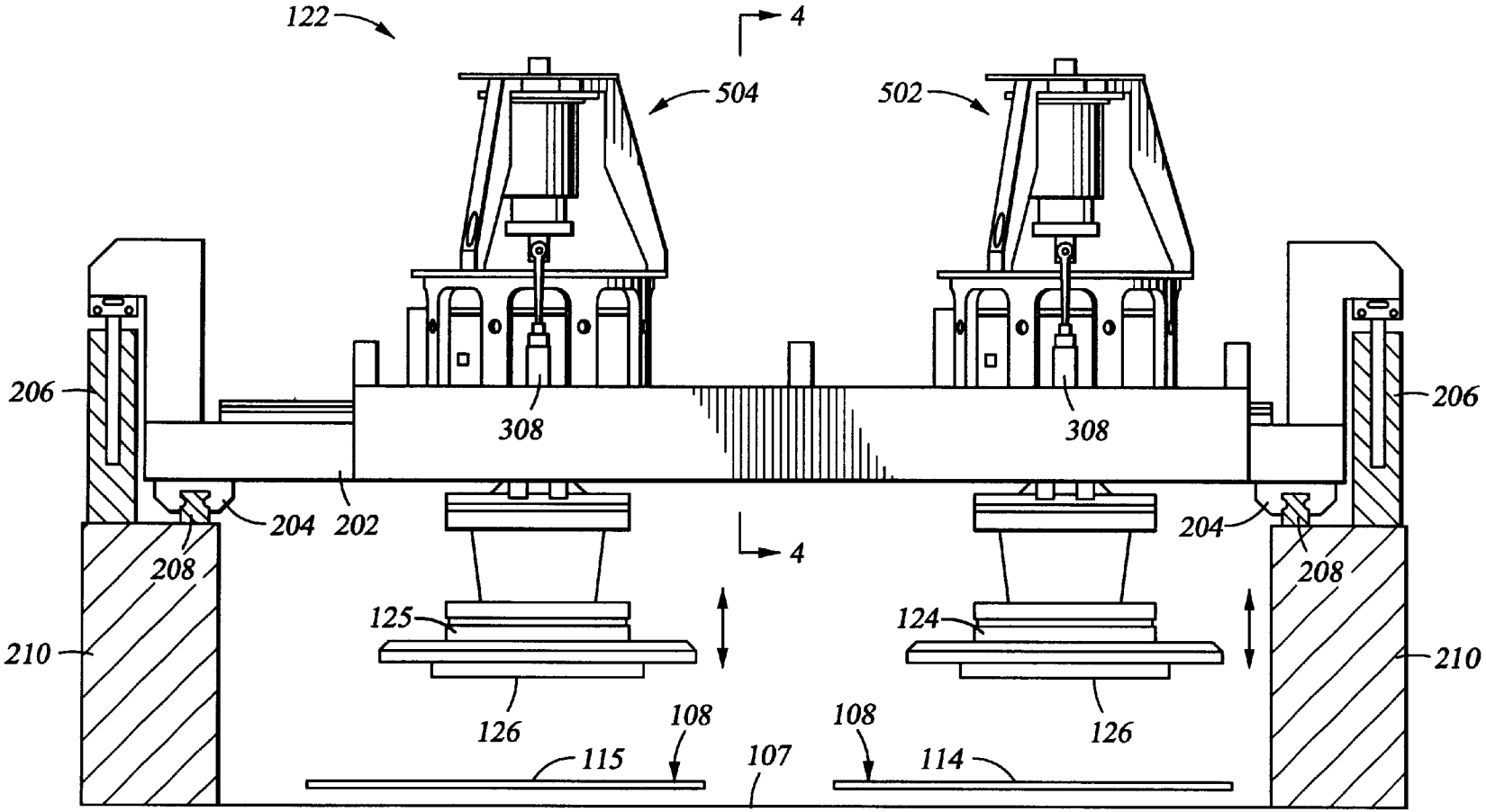
FIG. 3 is a side elevation of the chemical mechanical planarization system of FIG. 1.
Figure 4:
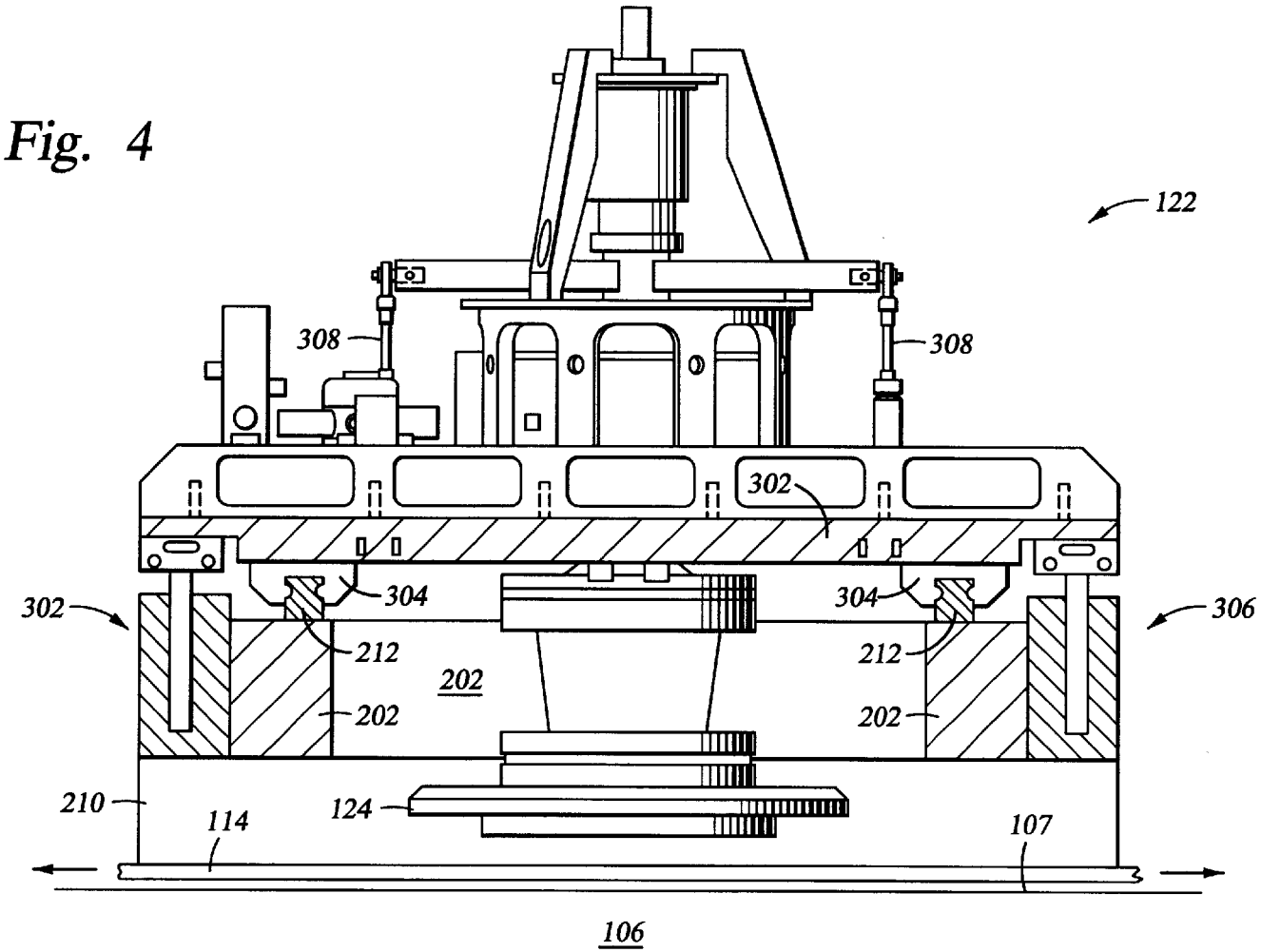
FIG. 4 is a cross sectional view of the drive system of FIG. 3 taken along section line 4—4.

FIGS. 2, 3 and 4 are a perspective view of the drive system 104, a side elevation of the drive system 104, and a cross sectional view of the side elevation of the drive system 104, respectively. The first linear motion device 120 generally comprise a stage 202, a roller bearing guide 204 and a driver 206. The stage 202 is fabricated from aluminum or other light weight material. The stage 202 may comprise stiffening ribs to minimized the deflection in a direction normal the base 106. The use of such light weight materials minimizes the inertia of the stage 202 that effects stage motion. The guide 204 is coupled to the stage 202 and interfaces with a rail 208 disposed upon a support 210 fixed to two sides of the base 106. The guide 204 allows the stage 202 to move along the support 210 in a linear motion generally parallel to the length of the webs 108*a* and 108*b*. The guide 204 may alternatively comprise solid bearings, air bearings or similar devices to provide similar motion. The driver 206 provides motion to the stage 202 relative to the base 106. The driver may comprise "Sawyer" motors, ball screws, cylinders, belts, rack and pinion gears, servo motors, stepper motors and other devices for creating and controlling linear motion. Generally, one portion of the driver 206 is connected to the support 210 while a second portion is connected to the stage 207.

The second linear motion device 122 generally comprises a carrier 302, a roller bearing guide 304 and a driver 306. The carrier 302 is also fabricated from aluminum or other light weight material. The guide 304 is coupled to the carrier 302 and interfaces with a rail 212 disposed on the stage 202. The guide 304 allows the carrier 302 to move along the stage 202 in a linear motion perpendicular to the motion of the stage. The guide 304 may alternatively comprise solid bearings, air bearings or similar devices. The driver 306 provides motion to the carrier 302 relative the stage 202. The driver 306 may comprise "Sawyer" motors, ball screws, cylinders, belts, rack and pinion gears, servo motors, stepper motors and other devices for creating and controlling linear motion.

The carrier 302 further comprises the first polishing head 124 and the second polishing head 125. The polishing heads 124 and 125 are coupled to the carrier 302 in a position such that the first polishing head 124 is disposed above the first web 108*a* and the second polishing head 125 is disposed above the second web 108*b*. Additional polishing heads may be incorporated such that all polishing heads residing above a web are orientated substantially along the length of the web. Each polishing head 124 and 125 are coupled to the carrier 302 via one or more actuators 308 that provide motion to the polishing heads (124 and 125) in a direction normal to the working surface 107 of the base 106. The motion provided by the first and second linear motion devices (120 and 122) move the carrier 302 in an x/y motion relative the webs (108*a* and 108*b*). The range of motion allows the wafer 126 disposed in the polishing heads 124 and 125 to contact the respective webs 108*a* and 108*b*.

Figure 5:
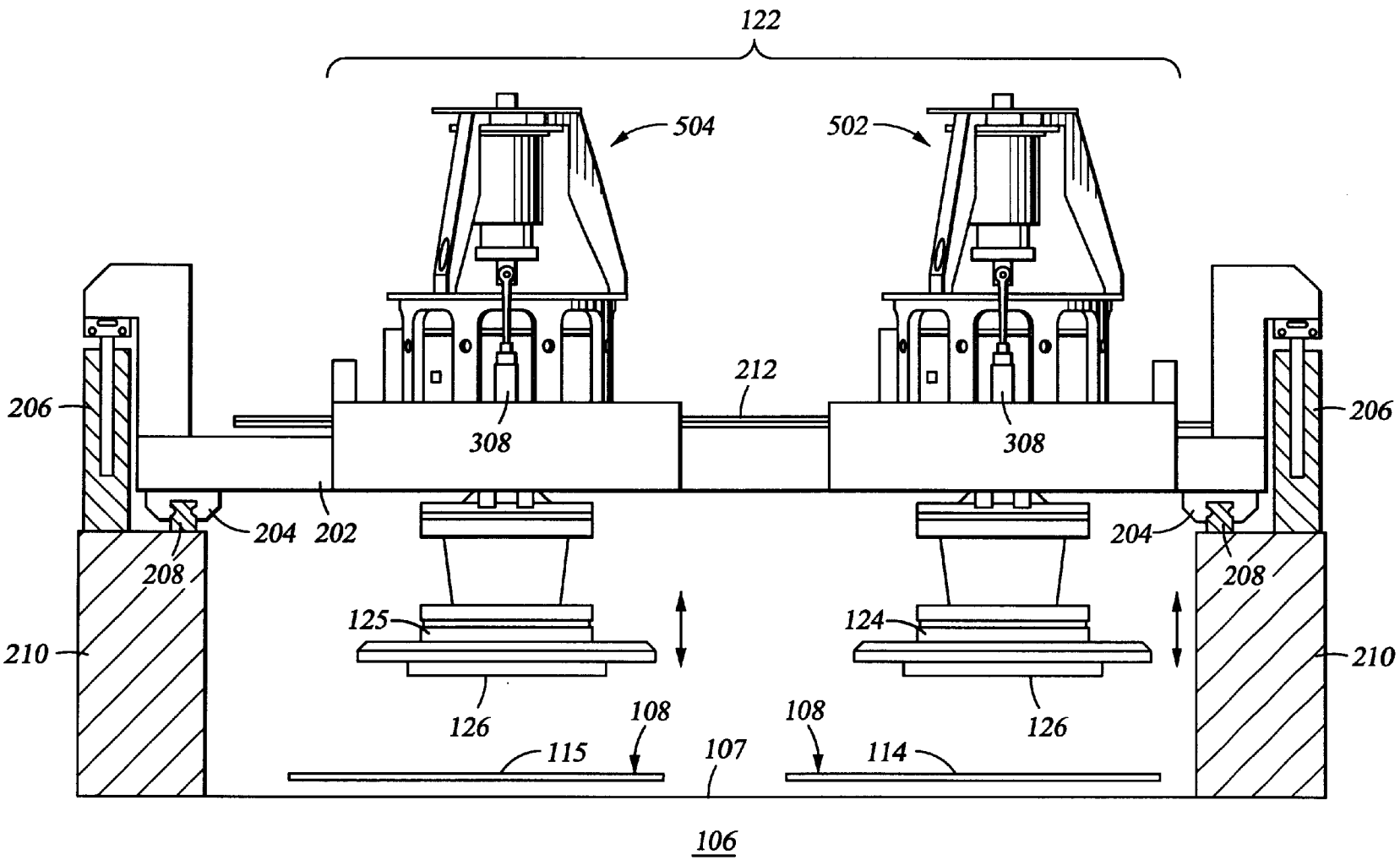
FIG. 5 is a side elevation of another embodiment of a drive system.

Alternatively, as depicted in FIG. 5, the second linear motion device 122 may comprise a third linear motion device 502 and a fourth linear motion device 504. The third linear motion device 502 couples the first polishing head 124 to the first linear motion device 120. The fourth linear motion device 504 couples the second polishing head 125 to the first linear motion device 120. The third linear motion device 502 and the fourth linear motion device 504 may be programmed to move in unison or independently from one another such that one polishing head may be programmed to move in a polishing pattern independent from the other polishing head.

The exemplary system 100 of FIG. 1 depicts the polishing heads (124 and 125) coupled to a carrier 302 disposed respectively over the first and second webs of polishing media (108*a* and 108*b*) wherein the carrier is coupled to a drive system 104 that provides an x/y motion to the polishing heads relative the webs. However, the invention described herein is equally applicable to other drive systems including those in which wafers are moved rotationally over webs of polishing media (i.e., two polishing webs) and those in which the polishing media webs are moved under fixed wafers.

Figure 6:
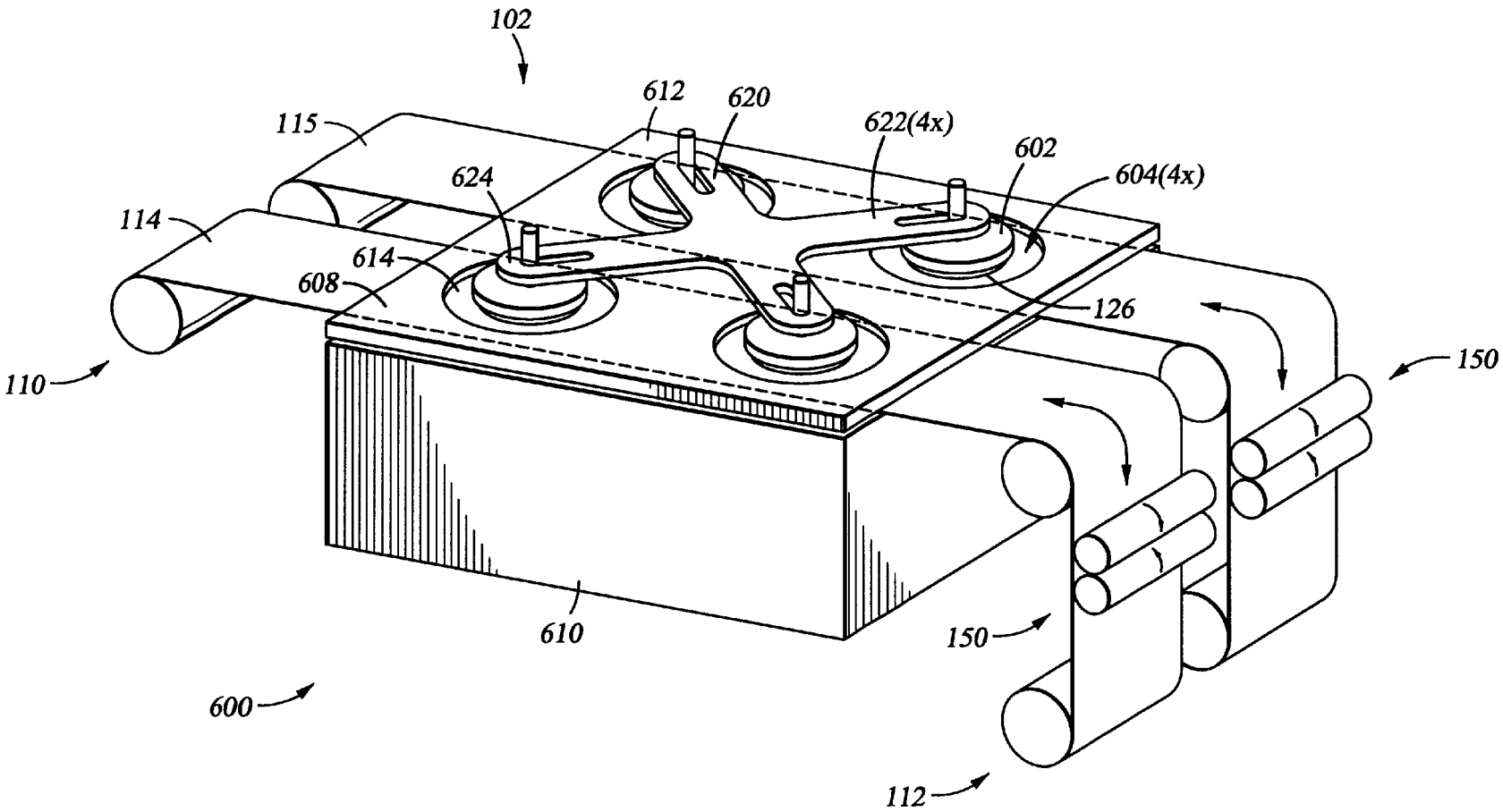
FIG. 6 is another embodiment of a chemical mechanical planarization system of the invention.

FIG. 6 depicts an embodiment of the present invention having a planarization system 600 incorporating a carrier in the form of a carousel 620. The system 600 comprises a polishing media magazine 102 having a first web 108*a* and a second web 108*b* of polishing media disposed between an unwind 110 and winder 112. The first and second web (108*a* and 108*b*) are disposed atop a base 610.

The base 610 comprises a top 608 that defines two or more substantially circular polishing stations 604 wherein at least one polishing station 614 is disposed atop the first web 108*a* and at least another polishing station 612 is disposed atop the second web 108*b*. The carousel 620 is centrally disposed atop the base 610 and has two or more arms 622. Each arm supports a drive system 624 that operably couples a polishing head 604 to the arm 622. The drive system 624 rotates the polishing head 604 and provides the polishing head 604 with a translation motion in relation to the webs 108*a*, 108*b*. Typically, the translational motion is provided long the axis of the arms 622. Additionally, the drive system 624 actuates the polishing head 604 selectively against the polishing webs 108*a*, 108*b*.

Each polishing head 604 is configured to retain the wafer 126 while polishing the wafer 126 in a predetermined polishing pattern. The polishing head 604 rotates while moving in a x/y-plane (i.e., the plane of the working surface of the polishing media). The wafer 126 is held against the working surface along a z-axis of the polishing head 604. The rotation about the z-axis coupled with the movement in the x/y plane to create an planarization pattern between the wafer 126 and the webs 108*a* and 108*b* of polishing media. Optionally, the carousel 620 may be oscillated (i.e., rotate in one direction or back and forth about the center of the carousel) to polish the wafer 126 over a larger area of the webs 108*a*, 108*b*.

Referring to FIGS. 1 and 2, in operation, the wafer 126 is retrieved from the wafer cassette 168 by the robot 166. The robot 166 transfers the wafer 126 to the substrate support 174. The edge grip robot 172 retrieves the wafer 126 and transfers the wafer to the load cup 164. Typically, when the shuttle comprises more than one load cup 164, additional wafers are placed in the other load cups 164 present on the shuttle 162. The shuttle 162 moves the load cups 164 into the position below the polishing heads 124 and 125. The load cups 164 raise the wafers 126 into the polishing heads 124 and 125 where they are retained for processing. Alternatively, the polishing heads may actuate downward to receive the wafer from a stationary load cup or the polishing heads and load cups may both move towards each other. The load cups 164 move clear from the polishing heads 124 and 125. The shuttle 162 moves from under the polishing heads 124 and 125.

The polishing heads 124 and 125 are lowered to contact wafers 126 disposed in the polishing heads with the respective working surfaces 118 and 119 of the first and second webs 108*a* and 108*b*. Wafers 126 disposed in the polishing heads 124 and 125 are set in motion relative to the working surfaces 118 and 119. A polishing fluid provided through nozzles 190 can be disposed between the wafers 126 and the working surfaces 118 and 119 to facilitate material removal from a feature side of the wafers 126 in contact with the first and second webs 108*a* and 108*b*. Polishing fluids may contain abrasive particles. Generally, the particular polishing fluid is selected with regard to the substrate material to be polished and the type of polishing pad to be used. Examples of polishing fluids include de-ionized water, ammonium hydroxide, potassium hydroxide, oxidizers, complexing agents, inhibitors, solubizers, buffers, abrasive slurry or any combination thereof.

For example, when polishing copper using a fixed abrasive pad, the polishing fluid generally includes an oxidizer that forms CuO on the surface of the copper. A complexing agent in the polishing fluid, such as $NH_3$, bonds with the CuO to form $Cu(NH_4)_{1-6}$. Additionally, an inhibitor, such as BTA, is provided that also bonds with the CuO, competing with the completing agent for sites on the CucO surface. As $Cu(NH_4)_{1-6}$ is relatively soluble, this compound moves from the surface of the copper and into solution, while the BTA-CuO compound remains relatively stable on the surface of the copper. Thus rate of chemical removal of copper from the surface may be controller by controlling the ratio of the inhibitors to complexing agents.

Once polishing is complete, the polishing heads 124 and 125 lift the polished wafers 126 clear of the webs 108*a* and 108*b*. The shuttle 162 again moves beneath the polishing heads 124 and 125 and retrieves the polished wafers 126 into the load cups 164. The shuttle 162 moves clear of the polishing heads 124 and 125, and the edge grip robot 172 transfers the polished wafer 126 to the substrate support 174. The robot 166 transfers the polished wafers 126 from the substrate support 174 to the cleaner 170 where slurry and other contaminants are removed from the surface of the polished wafer 126. While the polished wafer 126 is being cleaned, the shuttle 162 is free to move other unpolished wafers from the cassettes 168 to the polishing heads 124 and 125. Once the polished wafer 126 is clean, the robot 166 transfers the cleaned wafer 126 from the cleaner 170 to the cassettes 168. It is believed that as the system employs multiple webs to polish more than one wafer simultaneously, greater throughput and reduced cost of ownership can be realized over systems that polish one wafer at a time.

Although the teachings of the present invention that have been shown and described in detail herein, those skilled in the art can readily devise other varied embodiments that still incorporate the teachings and do not depart from the spirit of the invention.

What is claimed is:

1. A semiconductor wafer planarization system for processing a wafer comprising:

a base;

a first web disposed over the base;

a second web disposed over the base, the second web advanceable independently from the first web;

a carrier having a first polishing head and a second polishing head, the first polishing head movably disposed over the first web, the second polishing head movably disposed over the second web; and a drive system operably coupling the carrier to the base.

2. The planarization system of claim 1, wherein the drive system further comprises:

a first linear motion device movably coupled to the base; and a second linear motion device movably coupled to the first linear motion device, wherein the second linear motion device is coupled to the carrier.

3. The planarization system of claim 2, wherein the first web and the second web are disposed between at least a winder and an unwind, the first web and the second web capable of being indexed or advanced between the winder and the unwind.

4. The planarization system of claim 2 further comprising one or more conditioning devices selectively disposed against the first and the second web.

5. The planarization system of claim 1, wherein the carrier further comprises:

a first carrier supporting the first polishing head; and, a second carrier supporting the second polishing head.

6. The planarization system of claim 1 further comprising:

a first linear motion device movably coupled to the base; and a second linear motion device comprising:

a third linear motion device movably coupled to the first linear motion device, the second linear motion device supporting the first carrier; and a fourth linear motion device movably coupled to the first linear motion device, the fourth linear motion device supporting the second carrier.

7. The planarization system of claim 5, wherein the first web and the second web are disposed between a winder and an unwind, the first web and the second web capable of being indexed or advanced between the winder and the unwind.

8. The planarization system of claim 5 further comprising a conditioning device selectively disposed against the first and the second web.

9. The planarization system of claim 1 further comprising a nozzle for disposing a polishing fluid on the first and the second web.

10. The planarization system of claim 9, wherein the polishing fluid is comprised of a fluid selected from the group of de-ionized water, ammonium hydroxide, potassium hydroxide, oxidizers, complexing agents, inhibitors, solubizers, buffers, abrasive slurry or any combination thereof.

11. A semiconductor wafer planarization system for processing a wafer comprising:

a polishing media magazine comprising:

a first web of polishing media; and a second web of polishing media, the second web of polishing media advanceable independently from the first web of polishing media;

a base having a polishing surface upon which a portion of the first web and the second web of polishing media are disposed;

a drive system comprising:

a first linear motion device movably coupled to the base; and a second linear motion device movably coupled to the first linear motion device;

a first polishing head coupled to the second linear motion device and disposed over the first web; and a second polishing head coupled to the second linear motion device and disposed over the second polishing web.

12. The semiconductor wafer planarization system of claim 11, wherein the polishing media magazine further comprises one or more conditioning devices that selectively contact the first and the second web.

13. The semiconductor wafer planarization system of claim 11 further comprising:

a nozzle for disposing a polishing fluid on the first and the second web; and wherein the polishing fluid is comprised of a fluid selected from the group of de-ionized water, ammonium hydroxide, potassium hydroxide, oxidizers, complexing agents, inhibitors, solubizers, buffers, abrasive slurry or any combination thereof.

14. The planarization system of claim 2 further comprising:

a third polishing head coupled to the carrier and disposed above the first web; and a fourth polishing head coupled to the carrier and disposed above the second web.

15. The semiconductor wafer planarization system of claim 11, wherein the drive system further comprises:

a third polishing head coupled to the second linear motion device and disposed over the first web, and a fourth polishing head coupled to the second linear motion device and disposed over the second polishing web.

16. The semiconductor wafer planarization system of claim 11, wherein the polishing media magazine further comprises:

a third web disposed on the base; and wherein the drive system further comprises:

a third polishing head coupled to the second linear motion device and disposed over the third web.

* * * * *